US009808388B2

(12) United States Patent
Powell, Sr.

(10) Patent No.: US 9,808,388 B2
(45) Date of Patent: Nov. 7, 2017

(54) SELF OR ASSIST-OPERATED HUMAN FLOOR LIFT

(71) Applicant: IndeeLift Inc., Livermore, CA (US)

(72) Inventor: Steven Jay Powell, Sr., Livermore, CA (US)

(73) Assignee: IndeeLift Inc., Livermore, CA (US)

( * ) Notice: Subject to any disclaimer, the term of this patent is extended or adjusted under 35 U.S.C. 154(b) by 135 days.

(21) Appl. No.: 14/728,686

(22) Filed: Jun. 2, 2015

(65) Prior Publication Data

US 2015/0351985 A1 Dec. 10, 2015

Related U.S. Application Data

(60) Provisional application No. 62/009,078, filed on Jun. 6, 2014.

(51) Int. Cl.
*A61G 7/10* (2006.01)

(52) U.S. Cl.
CPC ..... *A61G 7/1011* (2013.01); *A61G 7/1015* (2013.01); *A61G 7/1046* (2013.01); *A61G 7/1059* (2013.01); *A61G 7/1074* (2013.01); *A61G 7/1092* (2013.01); *A61G 2203/12* (2013.01); *A61G 2203/18* (2013.01)

(58) Field of Classification Search
CPC .. A61G 7/1011; A61G 7/1074; A61G 7/1092; A61G 7/1015; A61G 7/1046; A61G 7/1059; A61G 2203/18; A61G 2203/12
See application file for complete search history.

(56) References Cited

U.S. PATENT DOCUMENTS 3,310,816 A * 3/1967 James ..... A61G 7/1015 4/562.1
4,633,538 A * 1/1987 James ..... A61G 7/1019 187/200

(Continued)

FOREIGN PATENT DOCUMENTS

GB 2463960 A1 4/2010
WO 0047154 A2 8/2000
WO WO 00/47154 * 8/2000

OTHER PUBLICATIONS

Camel—Patient Lifting Cushion (700lbs+), Oak Pointe Medical Products, LLC; https://www.youtube.com/watch?v=7eZ5K7H_MjM, uploaded Mar. 18, 2008.

(Continued)

*Primary Examiner* — Robert G Santos
*Assistant Examiner* — Myles Throop
(74) *Attorney, Agent, or Firm* — Van Pelt, Yi & James LLP

(57) ABSTRACT

A self or assist-operated lift apparatus is disclosed. In various embodiments, the lift apparatus includes a vertical rail; a linear bearing positioned to be moved along the vertical rail; a drive mechanism coupled to the linear bearing and configured to move the linear bearing at a controlled rate along the vertical bearing between a first position at a lower end of a range of motion and a second position at an upper end of the range of motion; and a seat attached to the linear bearing, the seat being constructed at least in part of a substantially rigid material and having a size and shape suitable to accommodate a seated human occupant.

14 Claims, 11 Drawing Sheets

(56) References Cited

U.S. PATENT DOCUMENTS

| | | | | |
|---|---|---|---|---|
| 4,669,943 | A * | 6/1987 | Zamotin | A61G 7/1019 212/175 |
| 5,432,961 | A * | 7/1995 | Horton | A61G 7/1005 4/496 |
| 5,875,501 | A * | 3/1999 | Jury | A61G 7/1011 5/81.1 R |
| 6,941,595 | B1 * | 9/2005 | Michael | A61G 7/1011 297/344.12 |
| 7,611,203 | B1 * | 11/2009 | Roberts | A61G 7/1011 297/217.7 |
| 8,024,824 | B1 | 9/2011 | Westermann | |
| 8,777,238 | B1 * | 7/2014 | Blackwood | A61G 7/1011 280/47.25 |
| 2004/0075237 | A1 | 4/2004 | Beck | |
| 2007/0067905 | A1 * | 3/2007 | Wilder | A61G 7/1011 5/83.1 |
| 2011/0187169 | A1 * | 8/2011 | Stewart | A47C 1/12 297/332 |
| 2012/0104818 | A1 * | 5/2012 | Morris | A61G 5/1059 297/316 |
| 2015/0035333 | A1 * | 2/2015 | Schy | A61G 7/1011 297/331 |

OTHER PUBLICATIONS

Using a Hoyer Lift, caregiversstrainingvideos.com, https://www.youtube.com/watch?v=DinUBHOBIWU, uploaded Jan. 17, 2011.

Patient Lifting Systems from Mangar and Oak Pointe Medical Enterprises Now Offered by Rehabmart.com, PRWeb Online Visibility from Vocus., pp. 1-3, Aug. 30, 2012.

How to Use a Hoyer Lift. pp. 1-6. Retrieved from http://www.phc-online.com/How_to_use_Hoyer-Lift_a/146.htm, Oct. 2013.

Hoyer (R) Power Patient Lifters P-C_HLA-2 & HPL402, User Instruction Manual & Warranty. Distributed by Sunrise Medical Inc., 2001.

RoMedic StandUp Lift Chair: https://www.youtube.com/watch?v=_zW8ZnFFpkE, uploaded May 1, 2014.

* cited by examiner

SELF OR ASSIST-OPERATED HUMAN FLOOR LIFT

CROSS REFERENCE TO OTHER APPLICATIONS

This application claims priority to U.S. Provisional Patent Application No. 62/009,078 entitled SELF-OPERATED HUMAN FLOOR LIFT filed Jun. 6, 2014 which is incorporated herein by reference for all purposes.

BACKGROUND OF THE INVENTION

Lift mechanisms (e.g., forklifts, cranes, etc.) designed to lift material, cargo, devices and other items from a position on a pallet or the floor to a transport or storage location have been provided.

Devices designed to transfer humans from chairs, beds and other places to beds, chairs or other places with the help of one or two human helpers have been provided. Typically, the latter devices require a third party operator. Typical devices include a sling or harness in which the person being transferred is suspended. Apparatuses designed to assist in lifting a human from a sitting position in a chair to a standing position have been provided.

Inflatable devices, such as the CAMEL Patient Lifter™, have been provided to lift a person from the floor to a desired height. The person moves or is moved onto the device prior to inflation, after which a compressor inflates the device below the patient, lifting the patient to a design height.

There is a need for an effective way for a person who has fallen to the ground when others are not present and cannot get up without assistance to be lifted to a height from which they may be able to stand up and/or sit more comfortably until help arrives. There is a need for effective ways to safely lower a person from a height, e.g., of a seat or bed, to the floor, e.g., to be able to slide into a pool or tub that is flush with the floor, to be able to crawl or drag themselves to reach a phone, food, or other needed object, etc. Finally, there is a need for an effective way to transport patients without having to get them into and/or out of a flexible harness, from which a caregiver may otherwise have to be able to lift the patient.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; or a composition of matter. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An apparatus to lift humans or similar loads from the floor to a desired height above the floor and/or vice versa is disclosed. In various embodiments, an individual human may operate the apparatus (with or without assistance) to raise that same individual from the floor to an optimal position above the ground allowing that same individual to use the apparatus' hand rail, in some embodiments, as leverage to assist in standing up from a sitting-up position. Some embodiments may provide transfer functionality from a wheelchair or a commode or other device or fixture at standard heights of 16" to 20" above the floor to a position on the floor. In various embodiments, the apparatus may include a rigid seat configured to enable a human to slide himself/herself onto the seat. Controls may be provided to enable the person to control the lift apparatus, such as buttons integrated into and/or attached to the seat, a remote or other type control that may be accessible from a position seated on the seat, voice controls, etc.

Figure 1A:
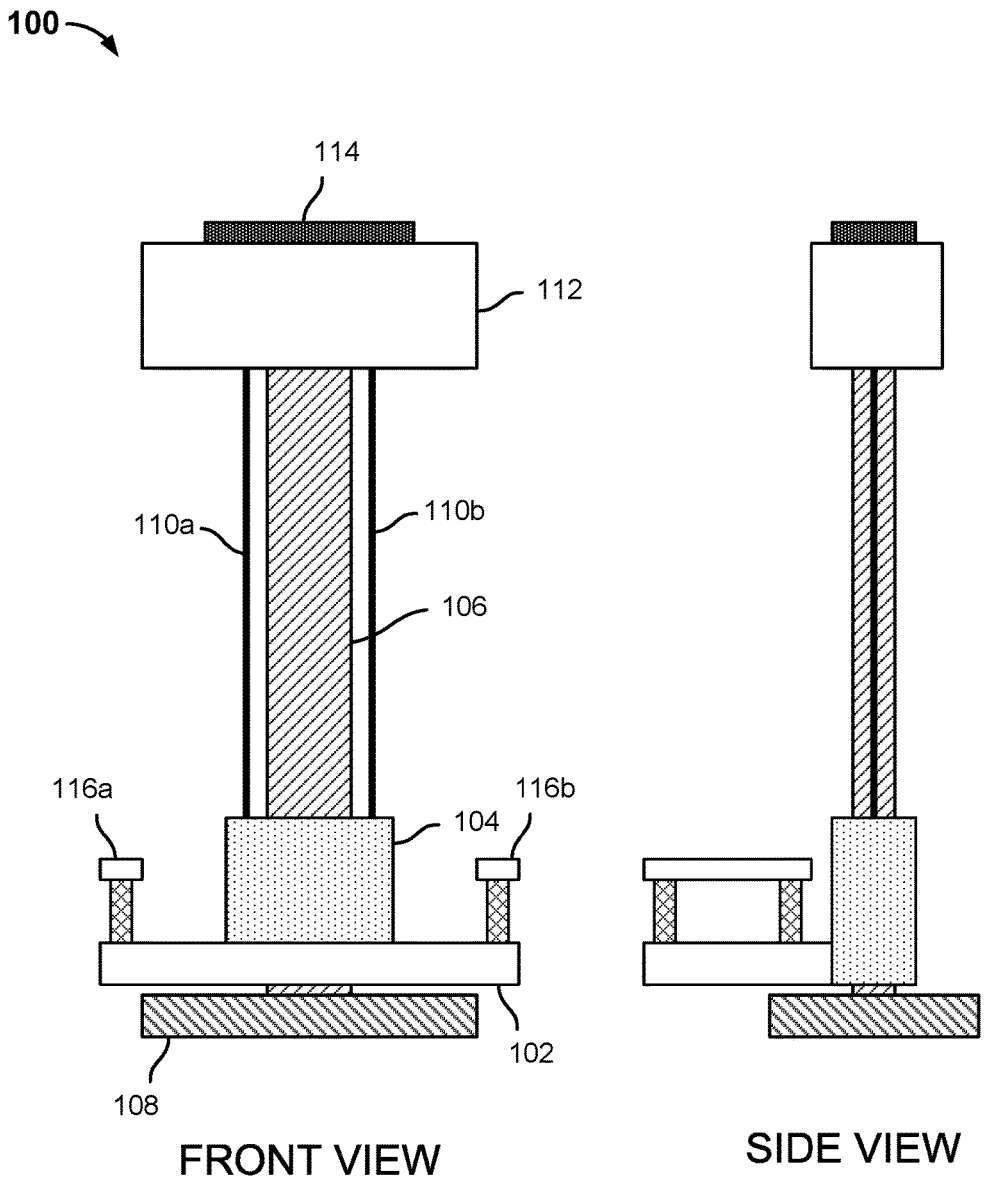
FIG. 1A is a block diagram illustrating an embodiment of a lift apparatus with the seat in a lowered position.

FIG. 1A is a block diagram illustrating an embodiment of a lift apparatus with the seat in a lowered position. In the example shown, the lift apparatus 100 includes a seat 102, shown in a lowered position, near the floor. The seat 102 in various embodiments may be constructed using a rigid material, such as molded plastic, sheet metal, wood, rigid composite materials, etc. In various embodiments, the lift seat may be fixed or retractable (fold up) and engineered to support a human payload of any weight with basic implementation for up to 300 pounds and heavy duty implementation to 600 pounds and larger and includes a seat with dimensions that comply with ADA specifications as defined in the ADA standard for Benches, Toilets, and other compliant seating mechanisms. In some embodiments, the seat 102 may be 16 to 26 inches wide and/or 10 to 24 inches deep.

The seat 102 is attached fixedly to a linear bearing 104. Linear bearing 104 is mounted movably on a vertical rail 106. As used herein, the term "linear bearing" refers broadly to an element configured to bear a load through movement along a longitudinal axis of a rail, guide, or similar linear path and/or structure. Vertical rail 106 may be any suitable material capable to bearing the required load, e.g., extruded aluminum. Vertical rail 106 is mounted fixedly in a baseplate 108. In some embodiments, baseplate 108 may comprise a flange with bolt holes to enable the lift apparatus 108 to be bolted to the floor, e.g., along or near a wall to which the lift apparatus 100 may be mounted. Cables 110*a* and 110*b* are attached to linear bearing 104, to enable linear bear 104 and components affixed thereto to be raised and/or lowered along vertical rail 106.

A drive assembly 112 is provided to raise and/or lower the linear bearing 104 and the seat 102 attached thereto. In various embodiments, drive assembly 112 includes a power supply, such as a rechargeable battery, and one or more motors configured to rotate one or more drums in a first rotational direction to wind cables 110*a* and 110*b* onto said drum(s), thereby causing the linear bearing 104 and seat 102 to be raised and/or in a second rotational direction to allow cables 110*a* and 110*b* to unwind from said drum(s), thereby allowing the linear bearing 104 and seat 102 to be lowered. In the example shown, a solar cell/array 114 is disposed on a top surface of drive assembly 112. In various embodiments, solar cell/array 114 converts ambient (e.g., indoor) light to electric current sufficient to (re)charge one or more rechargeable batteries comprising the drive assembly 112.

The seat 102 has attached thereto a pair of arm rests 116*a* and 116*b*. In various embodiments, arm rests 116*a* and 116*b* may serve to make it more comfortable for a person to be seated on seat 102 and/or may help to prevent an accidental fall off of seat 102. In various embodiments, the arm rests 116*a* and 116*b* are affixed to seat 102 in a manner that makes it possible to readily remove them and/or move them out of the way while a person gets onto seat 102. For example, in some embodiments, the arm rests 116*a* and 116*b* are removable. For example, the arm rests 116*a* and 116*b* may slide into recesses in seat 102 and may be removed by pulling the arm rests up and out of the recesses. Alternatively, the arm rests 116*a* and 116*b* may be configured to fold down and out to the sides of seat 102, and/or to swing out and away from the sides of seat 102, e.g., around a rear post or other attachment point towards the rear of seat 102, i.e., a point nearest to vertical rail 106. In some embodiments, arm rests 116*a* and 116*b* may be pulled out and/or pushed in along an axis substantially parallel to a front edge of the seat 102, e.g., to make the space available to receive a person wider and/or narrower as needed.

Figure 1B:
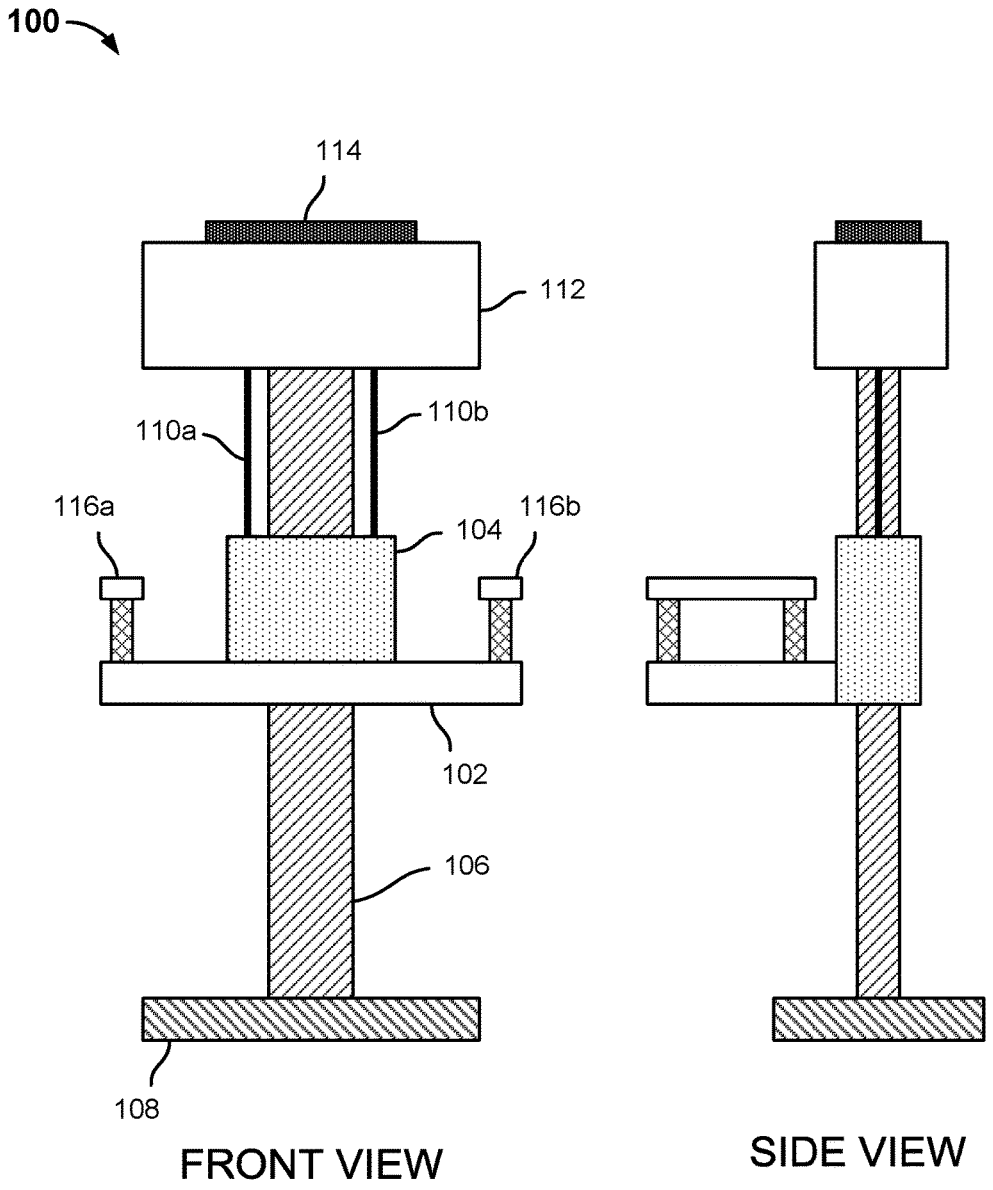
FIG. 1B is a block diagram illustrating an embodiment of a lift apparatus with the seat in a raised position.

FIG. 1B is a block diagram illustrating an embodiment of a lift apparatus with the seat in a raised position. In the example shown, the seat assembly, i.e., seat 102, linear bearing 104, and arm rests 116*a* and 116*b*, of lift apparatus 100 has been raised. In various embodiments, the linear bearing 104 and elements affixed thereto may have been raised to the position shown by actuating the drive assembly 112 to reel in the cables 110*a* and 110*b*, thereby causing the linear bearing 104 and elements affixed thereto (seat 102 and arm rests 116*a* and 116*b*, in this example) to travel upward along vertical rail 106 to the position shown.

In some embodiments, the lift apparatus 100 may be configured, e.g. via control electronics, electromechanical control mechanisms, etc., to raise the seat 102 from a position near the floor (e.g., 1 to 3 inches above the floor) to a position 17 to 19 inches above the floor. In various embodiments, arm rests 116*a* and 116*b* may be sized and located relative to seat 102 in such a way as to provide leverage to help a person to stand up once the seat 102 has been raised to a position 17 to 19 inches above the floor (16 to 20 inches in some embodiments).

In various embodiments, the lift apparatus 100 is designed to allow a human positioned on the floor to shimmy backwards, with or without help, on to the seat within 2 inches of the floor utilizing a diagonal mounting ramp that allows the smooth transitional slide from ⅛-⅜ inches from the floor to the seat level without a requirement to lift the human vertically, and grab the hand rails (e.g., arm rests 116*a* and 116*b*) and depress the lift switch or other activation mechanism (i.e. remote control or voice activation) and travel at a rate of speed, e.g., between 1 inch and 4 inches per second, to a position above the floor where the lift stops, allowing the individual to stand from a vertical sitting position. For example 16" to 19" from the floor as defined in the ADA seating.

The lift apparatus 100 is designed in some embodiments to allow the transfer from a wheelchair, commode, or other sitting fixture or device positioned 16 to 20 inches from the floor to a position within two inches from the floor.

In various embodiments, a motor or other mechanism in drive assembly 112 allows the seat assembly to descend under the force of gravity with the speed of descent being limited to remain within a design range of speeds and/or within a design maximum speed by an upward restraining force applied as needed to the cables 110*a* and 110*b*. In some embodiments, there is no downward pressure except the result of gravity, i.e., one cannot be crushed between the lowering seat and the baseplate/ground. In some embodiments, the weight of the seat (e.g., 15 to 26 pounds) plus the load on the seat equal the maximum downward force, for safety reasons. In some embodiments, the speed of descent may be controlled by limiting the motor to a design maximum speed of rotation. In some embodiments, the design maximum speed of descent/ascent is 13.75 feet per minute. In various embodiments, a design maximum speed in the range of 8 feet per minute to 20 feet per minute may be used.

Figure 2:
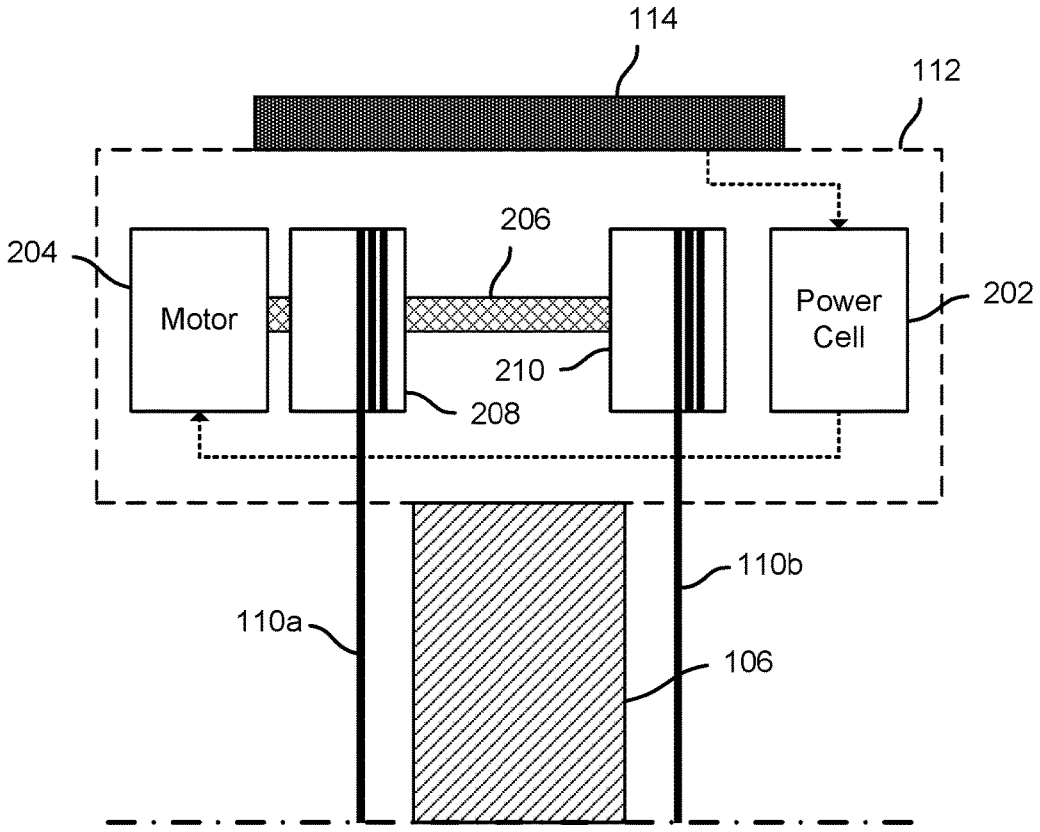
FIG. 2 is a block diagram illustrating an embodiment of a drive assembly portion of a lift apparatus.

FIG. 2 is a block diagram illustrating an embodiment of a drive assembly portion of a lift apparatus. In the example shown, the drive assembly 112 of the lift apparatus 100 of FIGS. 1A and 1B is shown to include in various embodiments a power cell (e.g., rechargeable battery) 202 configured to be recharged by solar cell(s) 114 and to provide power to drive an electric motor 204. The motor 204 rotates a shaft 206 to which drums 208 and 210 are coupled mechanically. In some embodiments, the motor 204 may be coupled to the shaft 206 and/or shaft 206 may be coupled to drums 208 and 210 by a reduction gear or other power transmission mechanism not shown in FIG. 2.

In various embodiments, the lift mechanism can be designed with a number of mechanical approaches including, by way of example and without limitation, cable driven winch (as shown in FIG. 2), motorized lead screw, or electric/hydraulic. The Lift mechanism can be engineered to provide service for multiple classes of device from lightweight residential to heavy-duty commercial versions depending on specific product implementations. The lift stroke is from within 2 inches from the floor to 17 to 19 inches above the floor for a total stroke of between 15 and 19 inches. The stroke parameter may be adjusted up or down for customized implementations supporting an unknown number of human sizes and/or physical anomalies.

The drive assembly 112 includes in some embodiments a 12V DC motor 204 rated between 750 and 2000 pounds, high-torque, and low voltage with an integrated reduction gear with a ratio of 153:1 and a customized drum designed (208, 210) for an output speed of 13.75 feet per minute (2.75 inches per second).

Figure 3:
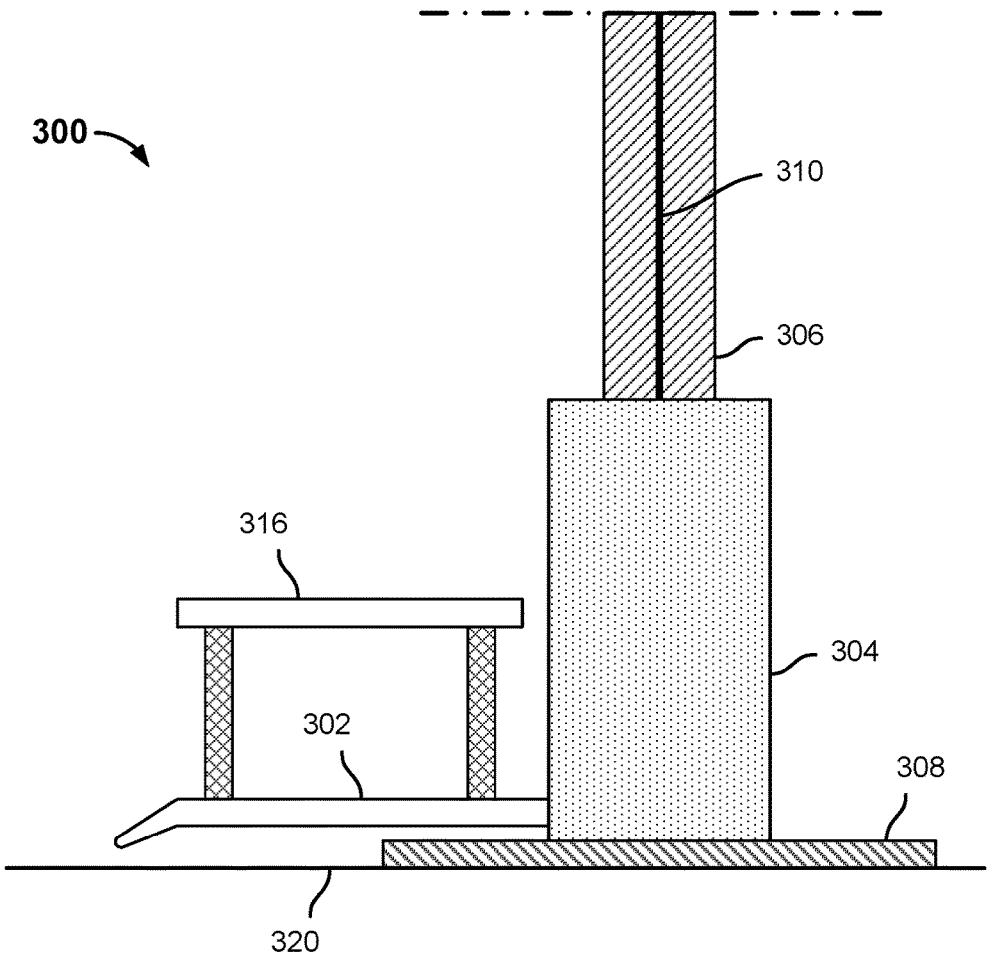
FIG. 3 is a block diagram illustrating an embodiment of a seat assembly portion of a lift apparatus.

FIG. 3 is a block diagram illustrating an embodiment of a seat assembly portion of a lift apparatus. In the example shown, the lift apparatus 300 includes a seat 302 affixed to a linear bearing 304 configured to be raised or lowered along a vertical rail 306 affixed to a baseplate 308 by reeling in (to raise) or paying out (to lower) cables 310 attached to linear bearing 304. The seat 302 has (optionally removable and/or movable) arm rests 316 attached thereto. The lift apparatus 300 is shown in a lowered position, with the seat 302 very near (e.g., within 1 to 3 inches) of the floor 320 on which the apparatus 300 is shown to be resting and/or installed. In the example shown, the seat 302 has a front lip portion that bends down toward the floor 320. In various embodiments, the seat 302 may be constructed of sheet metal or other rigid material that is capable of being formed and/or deformed during manufacturing to create a front lip portion, as in the example shown. In various embodiments, the front lip portion of the seat 302 may be of a size (e.g., length/depth) and/or shape (e.g., angle, front edge shape) designed to facilitate the (potentially) unassisted mounting of the seat by a person from a position on floor 320 that is adjacent to the seat 302. For example, in various embodiments, the front lip portion may extend to within an inch of the floor 320 and may enable a person to more readily shimmy up and onto the seat 302, enabling the person to be raised to a raised position as described herein (see, e.g., FIG. 1B).

Figure 4:
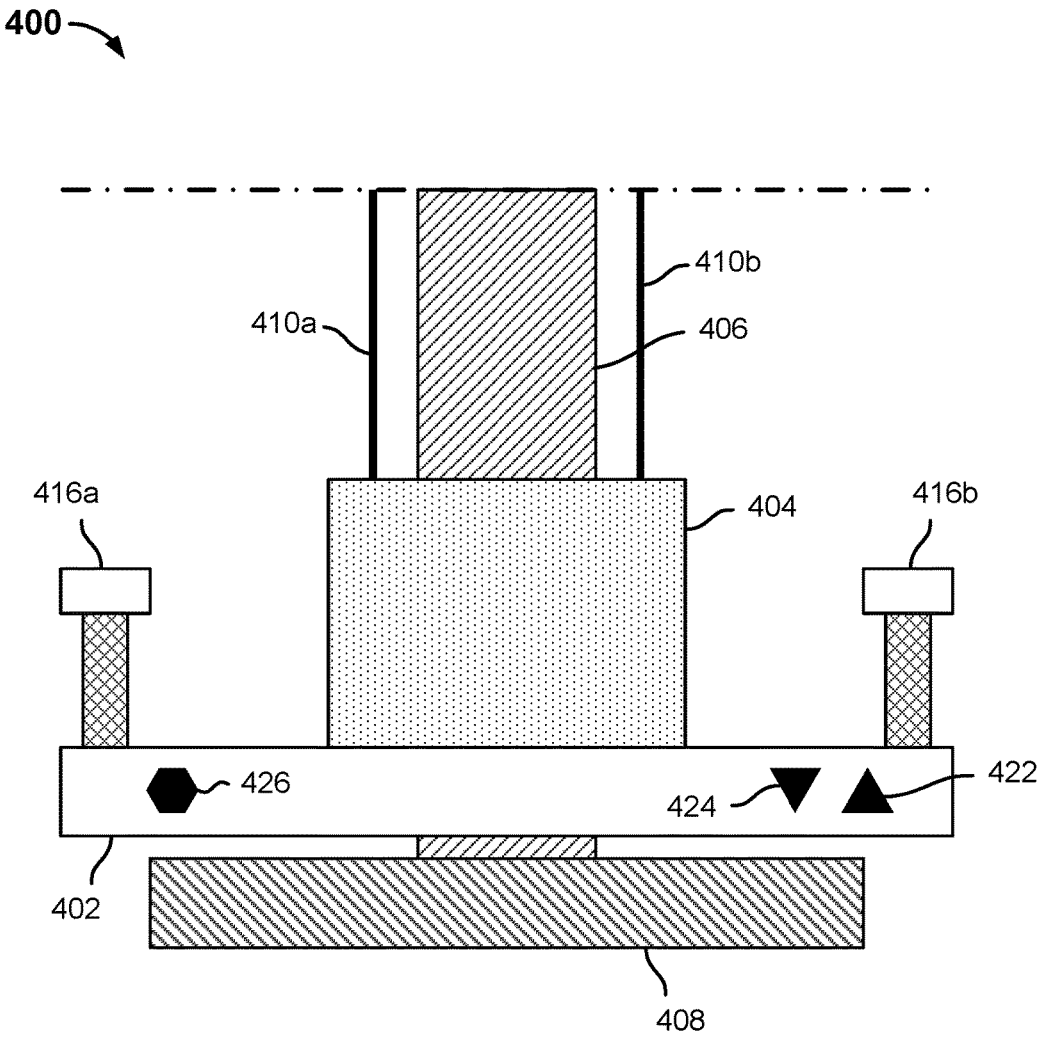
FIG. 4 is a block diagram illustrating an embodiment of a lift apparatus seat assembly in which user controls have been integrated.

FIG. 4 is a block diagram illustrating an embodiment of a lift apparatus seat assembly in which user controls have been integrated. In the example shown, a seat assembly portion of a lift apparatus 400 is shown in a lowered position. The lift apparatus 400 includes a seat 402 affixed to a linear bearing 404 configured to be raised or lowered along a vertical rail 406 affixed to a baseplate 408 by reeling in (to raise) or paying out (to lower) cables 410*a* and 410*b* attached to linear bearing 404. The seat 402 has (optionally removable and/or movable) arm rests 416*a* and 416*b* attached thereto. In the example shown, the seat 402 has operator controls 422, 424, and 426 integrated therein. Specifically, in this example the controls include an up button 422 to which the lift apparatus 400 is responsive to raise the seat 402; a down button 424 to which the lift apparatus 400 is responsive to lower the seat 402; and an emergency stop button 426 to which the lift apparatus 400 is responsive to stop and lock the seat 402 in position. In various embodiments, more or fewer controls may be provided. In some embodiments, controls such as buttons 422, 424, and/or 426 may be provided in addition and/or instead on a remote control or other handheld control device. For example, a remote control device may be provided and may be configured to rest in a pocket or other receptacle that is integrated with, attached to, magnetically adhered, and/or otherwise mounted on or nearby the lift apparatus 400 and/or seat 402. In some embodiments, voice activation may be provided.

In some embodiments, remote activation capability may be provided, e.g., via a networked computer, mobile device, or other remote device. A camera or other imaging device may be mounted in a patient or family member's room, for example, to enable a remote operator, family member, or other remote assistant to safely operate the lift once a patient or family member has moved themselves onto the lowered seat of the lift apparatus, for example.

Figure 5A:
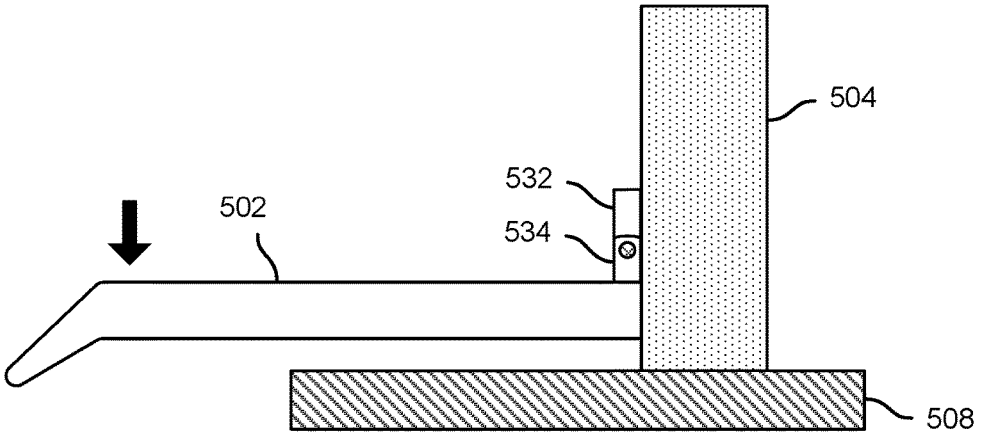
FIG. 5A is a block diagram illustrating an embodiment of a lift apparatus seat assembly in a deployed position.

FIG. 5A is a block diagram illustrating an embodiment of a lift apparatus seat assembly in a deployed position. In the example shown, seat 500 is attached to linear bearing 504 (which rides on a vertical rail that is not shown, e.g., attached to baseplate 508) by a spring or weight loaded hinge that includes a first portion 532 that is attached fixedly (e.g., screwed, bolted, glued, welded, etc.) to the linear bearing 504 and a second portion 534 attached fixedly to seat 502. In at least the deployed (seat 502 down and parallel to the floor) position shown, in various embodiments second hinge portion 534 is under a spring force that tends to rotate the second hinge portion 534 clockwise (when viewed from the side shown in FIG. 5A) relative to the first hinge portion 532, e.g., around a hinge pin or other axial member(s). In the position shown in FIG. 5A, a force represented by the large black arrow has been applied to rotate the seat 502 into the deployed position shown. For example, a user may have used his/her hand to pull the seat down into the position shown, and/or may be using his/her body weight to hold the seat 502 down, e.g., to enable the user to slide up and onto the seat 502.

Figure 5B:
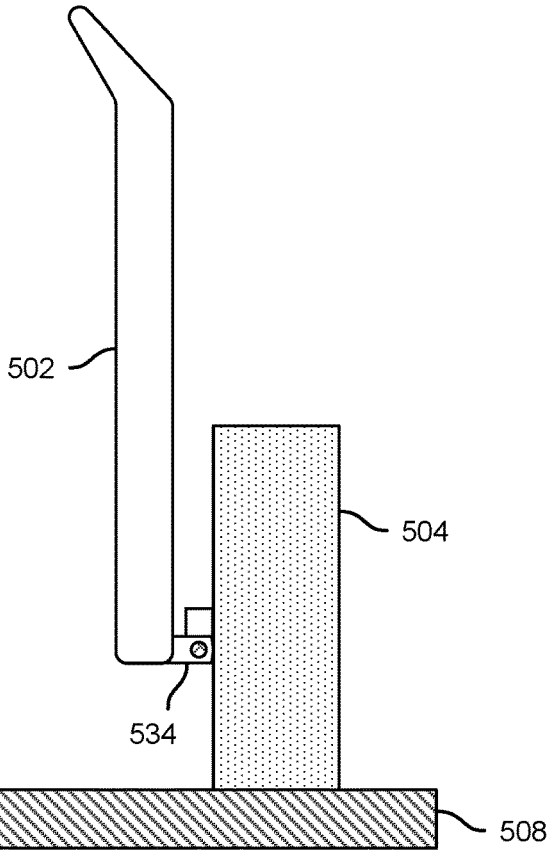
FIG. 5B is a block diagram illustrating an embodiment of a lift apparatus seat assembly in a stowed position.

FIG. 5B is a block diagram illustrating an embodiment of a lift apparatus seat assembly in a stowed position. In the example shown, the force holding the seat 502 down in the deployed position, as shown in FIG. 5A, has been removed, resulting in the seat 502 being rotated up into the stowed position as shown in FIG. 5B. Specifically, in this example the spring or weighted tension in the hinge comprising hinge portions 532 and 534 has caused the second hinge portion 534 to rotate to the position shown, which has resulted in the seat 502 being rotated up and into the stowed position as shown in FIG. 5B. In various embodiments, any mechanism that would cause the seat 502 to move to and remain in the stowed position shown in FIG. 5B when force is not applied to the seat may be used.

Figure 6:
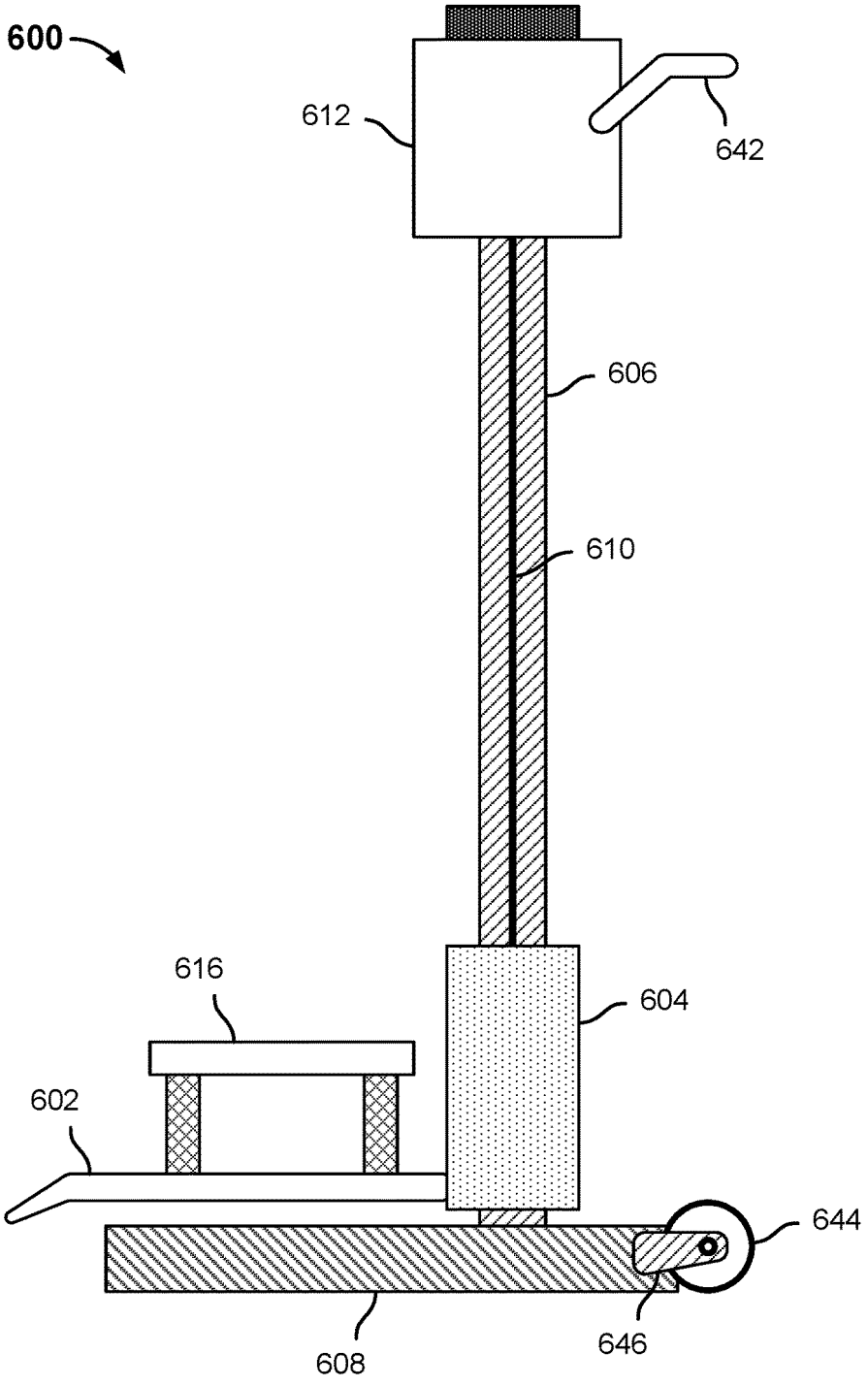
FIG. 6 is a block diagram illustrating an embodiment of a portable lift apparatus.

FIG. 6 is a block diagram illustrating an embodiment of a portable lift apparatus. In the example shown, lift apparatus 600 includes a seat 602 affixed to a linear bearing 604 configured to be raised or lowered along a vertical rail 606 affixed to a moveable baseplate 608 by reeling in (to raise) or paying out (to lower) cables 610 attached to linear bearing 604 on opposite sides of vertical rail 606. Actuation is provided by a drive assembly 612. The seat 602 has arm rests 616 attached thereto. A handle 642 is mounted on a housing of drive assembly 612. A wheel 644 is mounted on opposite sides of a back end of baseplate 608 by mounting brackets/flanges 646. The handle 642, wheels 644, and brackets/flanges 646 are designed to enable the lift apparatus 600 to be rocked back onto the wheels 644, e.g., by pulling back on handle 642 while using one's foot to prevent the baseplate 608 from slide or rolling backwards once the weight of the lift apparatus 600 begins to shift onto the wheels 644. Once the lift apparatus 600 has been rocked back onto the wheels 644, such that the weight of the lift apparatus 600 is balanced on the wheels 644 and baseplate 608 has been lifted fully (or at least sufficiently) clear of the floor, in various embodiments the handle 642 may be used to steer and roll the lift apparatus 600 to a desired location.

For example, in one use case, the lift apparatus 600 may be rolled to a position at the side of a bed, a chair, a wheel chair, etc. The seat 602 may be raised in such a use example to a height at or near the same height as a surface from which a patient or other human subject is to be transferred onto the seat 602 of lift apparatus 600. Once the subject has been transferred onto seat 602, in various embodiments, the subject may be strapped into the seat, e.g., using a seat belt of similar device (not shown) and the portable lift 600 may be moved to a destination in the same manner, e.g., rocked back onto wheels 644 and rolled to the destination. Alternatively, once the subject has been lifted, the subject may be transferred to a wheel chair or other transport equipment. Once at the destination, or at the original location, the seat 602 of lift apparatus 600 may be lowered to the floor to enable the person seated in the lift apparatus 600 to be transferred safely to the floor, e.g., to perform floor-based physical therapy or other activities.

Figure 7A:
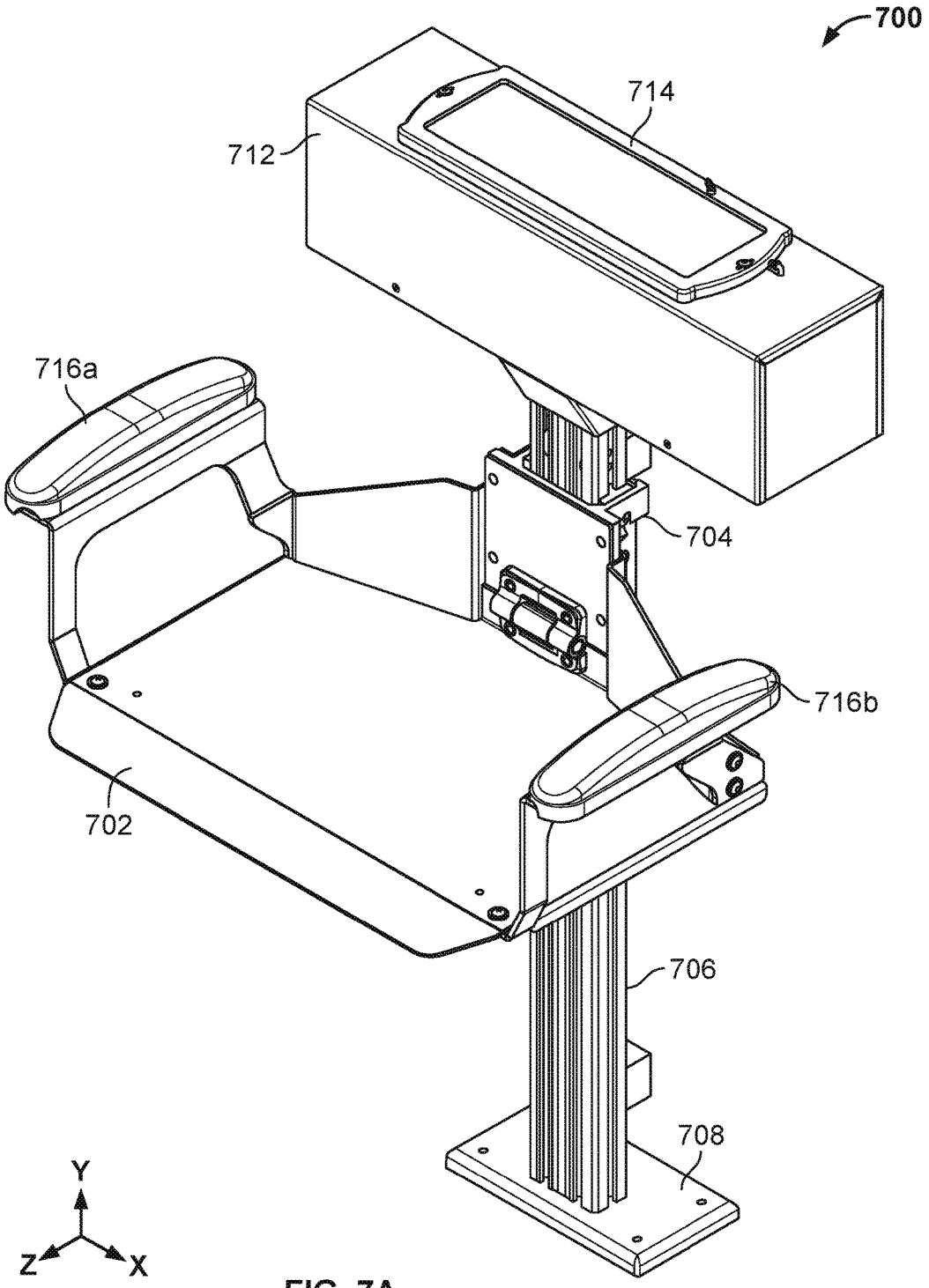
FIG. 7A is a block diagram illustrating in perspective view an embodiment of a stationary lift apparatus.

FIG. 7A is a block diagram illustrating in perspective view an embodiment of a stationary lift apparatus. In the example shown, lift apparatus 700 includes a seat 702 mounted to a linear bearing 704. Linear bearing 704 is coupled around vertical rail 706 in a manner that allows linear bearing 704, and seat 702 attached thereto, to be moved up and down along vertical rail 706. In this example, the vertical rail 706 may be constructed from extruded aluminum. In the example shown, vertical rail 706 includes a number of slots or grooves into which corresponding portions of linear bearing 704 extend and along and through which such portions of linear bearing 704 travel (e.g., slide) as linear bearing 704 moves up and/or down along vertical rail 706.

Vertical rail 706 is mounted fixedly to baseplate 708, which includes holes through which bolts or other fasteners may extend to bolt the lift apparatus 700 to a floor or other substrate.

A drive assembly 712 provides driving force to move linear bearing 704, and seat 702 attached thereto, along vertical rail 706, e.g., using cables (not shown in FIG. 7A). Solar cell(s) 714 generate electricity to recharge a battery comprising drive assembly 712.

In this example, seat 702 includes a front lip, as in the examples shown in FIG. 3, to enable a person to more readily slide onto the seat 702 from the floor when the seat 702 is in the lowered position. Seat 702 is attached to linear bearing 704 by a spring or tension-loaded hinge, as in the example shown in FIGS. 5A and 5B. Finally, seat 702 has attached thereto a pair of arm rests 716*a* and 716*b*, which in various embodiments may be removable and/or at least partly movable.

Figure 7B:
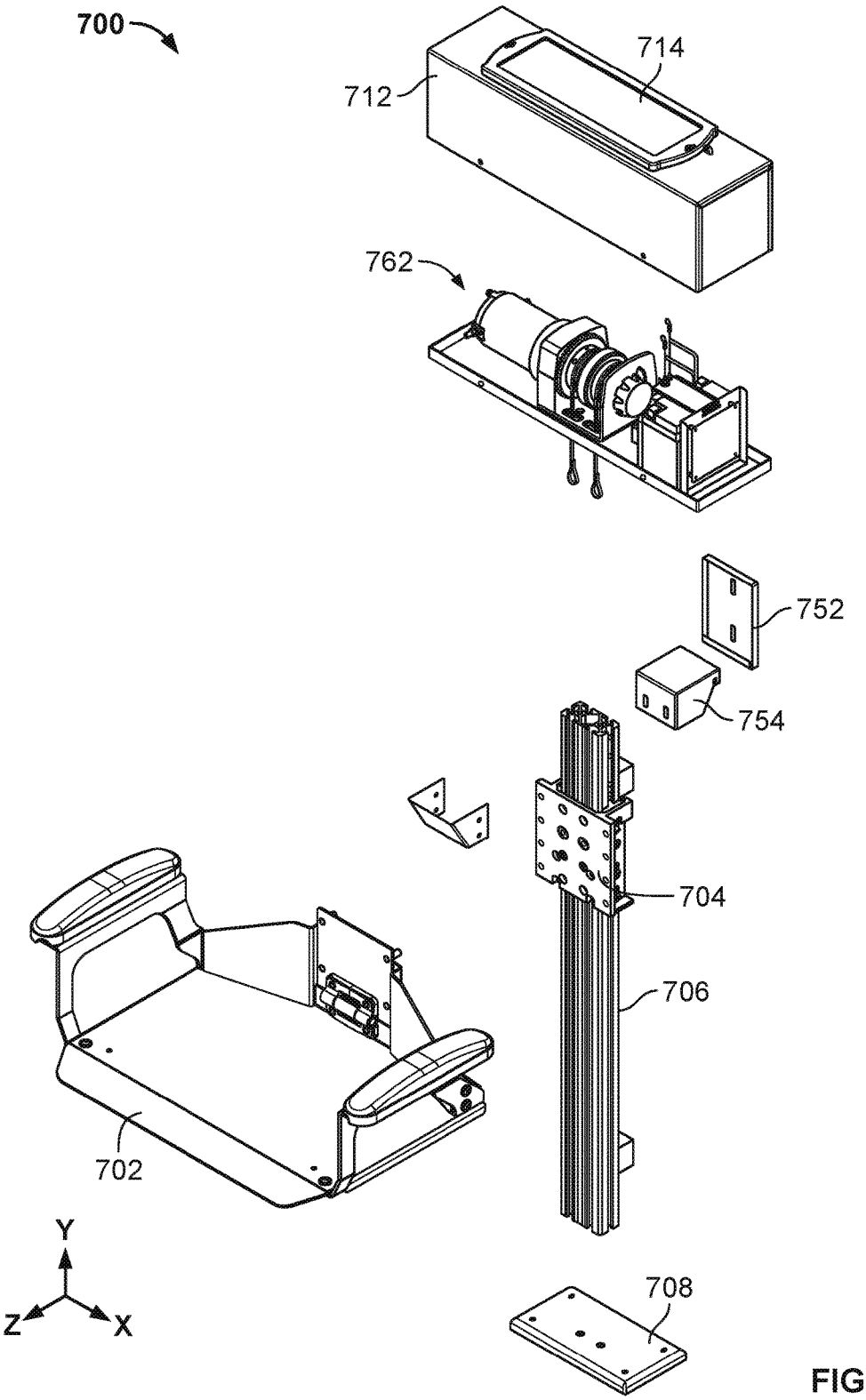
FIG. 7B is a block diagram illustrating in exploded view an embodiment of a stationary lift apparatus.

FIG. 7B is a block diagram illustrating in exploded view an embodiment of a stationary lift apparatus. In the example shown, lift apparatus 700 of FIG. 7A is shown to include in addition to the elements shown in FIG. 7A and described above a wall plate 752 to mount the lift apparatus 700 along a wall, e.g., at a wall stud, and a corresponding bracket 754 to secure an upper end of vertical rail 706 to the wall plate 752. In addition, drive assembly 712 is shown include a drive mechanism 762, which includes in this example a motor (left end), a winch drum and cables (center), and a battery/power supply (right end), along with peripheral and control elements.

Figure 8A:
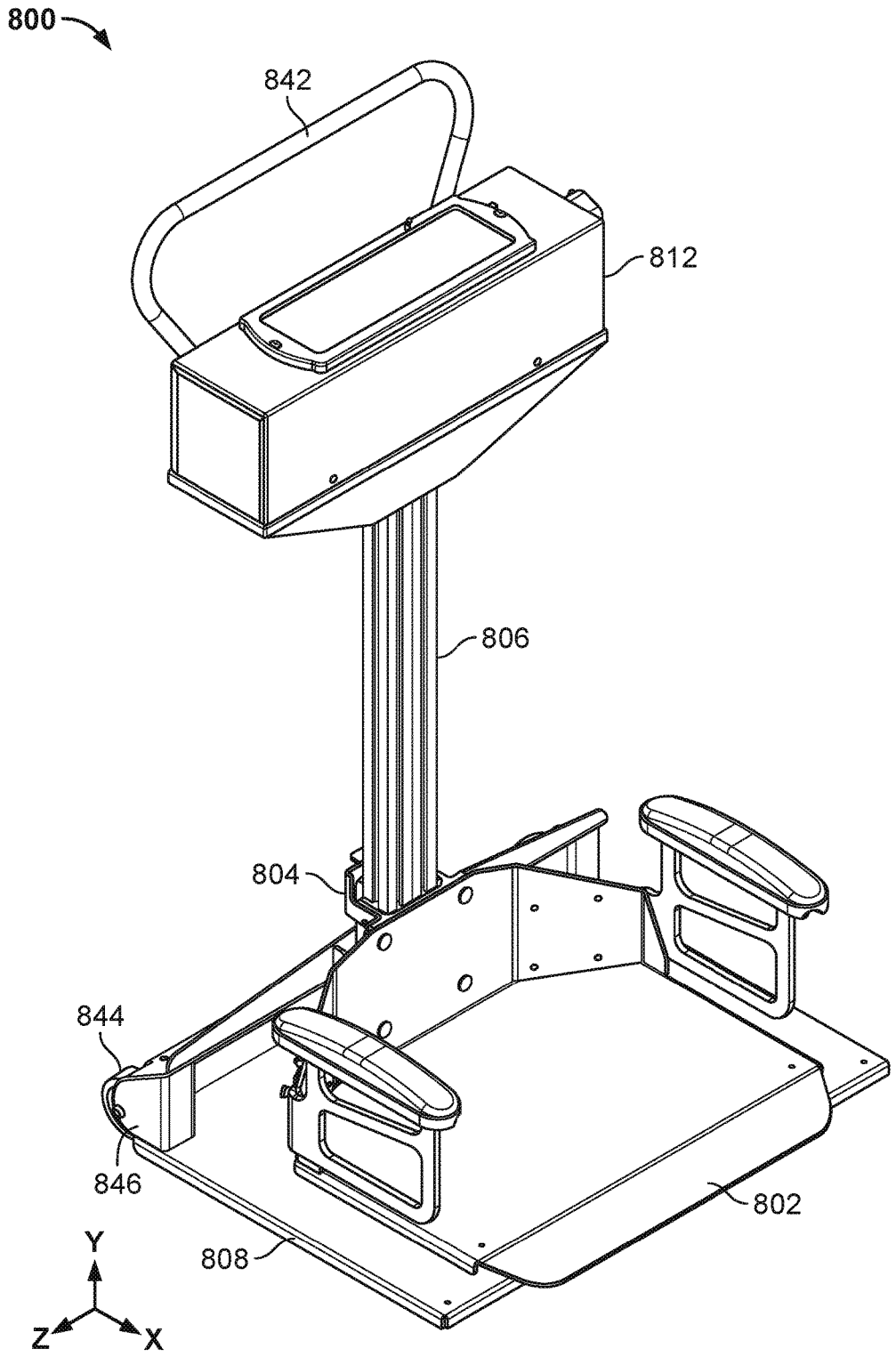
FIG. 8A is a block diagram illustrating in perspective view an embodiment of a portable lift apparatus.

FIG. 8A is a block diagram illustrating in perspective view an embodiment of a portable lift apparatus. In the example shown, the lift apparatus 800 includes a seat 802 mounted on a linear bearing 804 configured to move up and/or down along a vertical rail 806. The vertical rail 806 is attached to a moveable base plate 808. A drive assembly 812 provides a driving force to move the linear bearing 804 along the vertical rail 806. The lift apparatus 800 includes a handle 842 affixed to the housing of drive assembly 812. In addition, on each side of a rear edge of baseplate 808, a wheel (or roller) 844 is affixed to the baseplate via a bracket (flange, etc.) 846. As in the example shown in FIG. 6, the lift apparatus 800 may be moved in various embodiments by using handle 842 to rock the lift apparatus back onto wheels 844 and using the handle 842 to push the lift apparatus 800, while balanced on wheels 844, to a desired location.

Figure 8B:
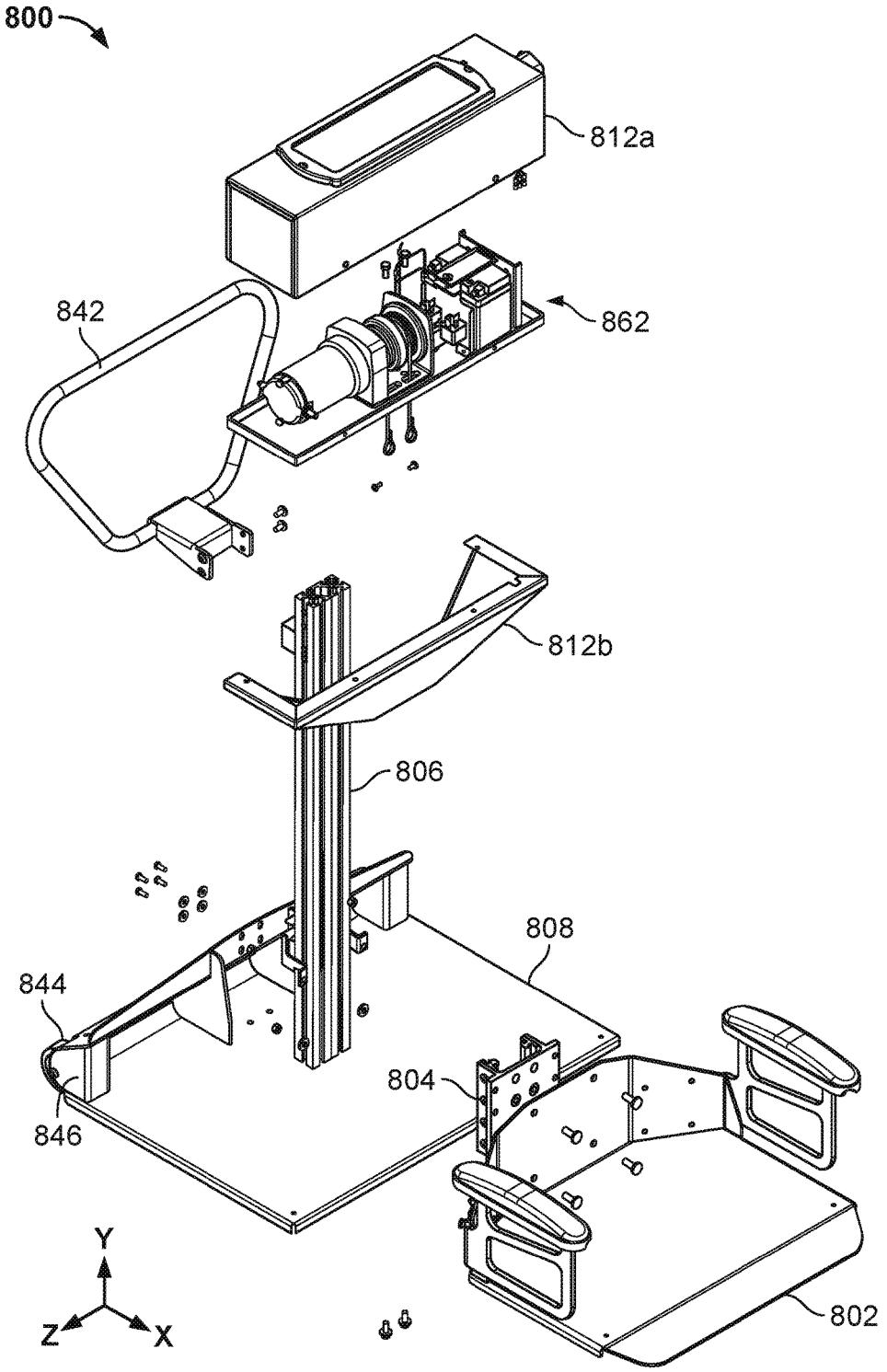
FIG. 8B is a block diagram illustrating in exploded view an embodiment of a portable lift apparatus.

FIG. 8B is a block diagram illustrating in exploded view an embodiment of a portable lift apparatus. In the example shown, drive assembly 812 of lift apparatus 800 is shown to include an upper housing portion 812*a* and a lower housing portion 812*b*. Handle 842 attaches to the apparatus at vertical rail 806. In addition, drive assembly 812 includes a drive mechanism 862 that includes components and functionality similar to those described above in connection with drive mechanism 762 of FIG. 7B.

In various embodiments, a lift apparatus as disclosed herein may include and/or comprise one or more of the following:

1) Self or assisted operated lift apparatus to raise a human user from the within 2 inches of the floor to a height of 17" to 19", as defined by the ADA for seating, to allow the most energy and muscle efficient procedure to achieve a standing position or standing up. The apparatus may include human-engineered features for lift safety and post-lift supports for the standing process.
2) Self or assisted operated lift apparatus to transfer a human from a wheel chair, commode or other device from a height of 16" to 20" above the floor to within 2 inches of the floor.
3) A specially designed lift seat with fixed or folding hand rails engineered with optimum placement, for the most efficient and safest mount and dismount from either the raised or lowered position and for transfers from other sitting apparatus like a wheelchair, commode or other fixture or device.
4) A specially designed lift seat with fixed or adjustable-width hand rails engineered with optimum placement, while being adjustable in equivalent distances on both sides of the primary seat to meet the needs of a plethora of different body sizes and shapes.
5) Adjustable lift-height-stop points between 10 and 30 inches allow flexibility for specific disabilities and physical anomalies as required by the mobility needs of the individual disability/user. Adjustable-on-installation stop height, customizable lift seat, lift activation mechanisms and other customizations are applicable variations for individual physical anomalies related to birth defects and the victims of accidents, amputees etc.

In various embodiments, the disclosed apparatus may enable elderly and disabled persons who are relatively mobile yet unable to get up from the floor without assistance to lift themselves off the floor and to a position from which they may be able to stand, for example in the event of a fall to the floor.

A self-operated lift apparatus as disclosed herein may be installed in various embodiments in a fixed location for the individual living alone or a portable apparatus in some embodiments may be used by someone living with a companion or assistant that would be able to place the lift directly where it is needed when they are unable to lift the other individual off of the floor without outside assistance.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A lift apparatus, comprising:

a vertical rail;

a linear bearing positioned to be moved along the vertical rail;

a drive mechanism coupled to the linear bearing and configured to move the linear bearing at a controlled rate along the vertical rail between a first position at a lower end of a range of motion and a second position at an upper end of the range of motion; and a seat attached to the linear bearing, the seat being constructed at least in part of a substantially rigid material, having a size and shape suitable to accommodate a seated human occupant, and having a plane to accommodate the seated human occupant, wherein the seat includes a front ramp portion that points in a direction away from the plane to accommodate the seated human occupant and extends away from the linear bearing, wherein the seat includes a back portion attached to the linear bearing, wherein said back portion at said first position is within two inches from the floor and the front ramp portion at said first position is an inch from the floor in order to facilitate an unassisted mounting of the seat by a user from a position on the floor that is adjacent to the seat.

2. The lift apparatus of claim 1, further comprising a baseplate to which a bottom end of the vertical rail is attached and wherein said first position comprises a position within two inches of the baseplate.

3. The lift apparatus of claim 1, further comprising a baseplate to which a bottom end of the vertical rail is attached and wherein said second position comprises a position between 17 and 19 inches above the baseplate.

4. The lift apparatus of claim 1, further comprising a baseplate to which a bottom end of the vertical rail is attached and a set of wheels or rollers attached to the baseplate in a location and manner that allows the apparatus lift to be balanced on said wheels or rollers and rolled to a destination.

5. The apparatus of claim 1, wherein the lift apparatus is mounted to a wall.

6. The apparatus of claim 1, wherein the seat is attached to the linear bearing at least in part by a spring loaded mechanism that causes the seat to fold up into a substantially vertical stowed position unless a force is applied to move the seat to a substantially horizontal deployed position.

7. The apparatus of claim 1, wherein the seat includes at a front end of the seat the front ramp portion that extends a front edge of the seat to a vertical position that is below a primary substantially horizontal plane defined by a non-ramp portion of the seat.

8. The apparatus of claim 1, further comprising arm rests or side rails that are removable or movably attached to the seat.

9. The apparatus of claim 1, further comprising a set of one or more controls integrated into or attached to the seat in a position that is accessible by a person seated on the seat.

10. The apparatus of claim 1, wherein the drive mechanism comprise a motor-driven cable reel.

11. The apparatus of claim 10, wherein the motor-driven cable reel is adapted to reel in or pay out one or more cables attached to the linear bearing.

12. The apparatus of claim 1, wherein the drive mechanism is configured to raise or lower the linear bearing and the seat attached thereto at or below a maximum design speed.

13. The apparatus of claim 1, wherein the design maximum speed is in a range from 8 to 20 feet per minute.

14. The apparatus of claim 1, wherein the drive mechanism limits a rate of gravity induced descent of the linear bearing and seat attached thereto but does not apply force to drive the linear bearing in a downward direction.

* * * * *